US010183784B2

(12) United States Patent
Lau

(10) Patent No.: US 10,183,784 B2
(45) Date of Patent: Jan. 22, 2019

(54) SYSTEMS AND METHODS ASSOCIATED WITH A STABILIZED STORAGE CONTAINER

(71) Applicant: Kelvin Lau, Austin, TX (US)

(72) Inventor: Kelvin Lau, Austin, TX (US)

( * ) Notice: Subject to any disclaimer, the term of this patent is extended or adjusted under 35 U.S.C. 154(b) by 7 days.

(21) Appl. No.: 15/653,254

(22) Filed: Jul. 18, 2017

(65) Prior Publication Data

US 2018/0044065 A1 Feb. 15, 2018

Related U.S. Application Data

(60) Provisional application No. 62/375,144, filed on Aug. 15, 2016, provisional application No. 62/395,342, filed on Sep. 15, 2016.

(51) Int. Cl.

| | |
|---|---|
| ***B65D 33/14*** | (2006.01) |
| ***B65D 30/00*** | (2006.01) |
| ***A63H 33/00*** | (2006.01) |
| ***A44B 11/00*** | (2006.01) |
| ***B25H 3/00*** | (2006.01) |

(52) U.S. Cl.

CPC ..... *B65D 33/14* (2013.01); *A44B 11/00* (2013.01); *A63H 33/00* (2013.01); *B25H 3/00* (2013.01); *B65D 29/00* (2013.01)

(58) Field of Classification Search

CPC ..... B65D 33/14; B65D 29/00; A44B 11/00; A63H 33/00; B25H 3/00

USPC ..... 383/13, 22–24, 117

See application file for complete search history.

(56) References Cited

U.S. PATENT DOCUMENTS

| | | | | |
|---|---|---|---|---|
| 3,014,759 | A * | 12/1961 | Bing | B60R 7/043 224/275 |
| 4,801,081 | A * | 1/1989 | O'Connor | A47G 29/1203 232/1 C |
| 4,953,765 | A * | 9/1990 | Little | A41D 13/0012 206/373 |
| 5,628,442 | A * | 5/1997 | Wayne | B60R 7/005 224/42.33 |
| 6,017,174 | A | 1/2000 | Ross et al. | |
| 6,053,570 | A * | 4/2000 | Stern | A47C 7/62 211/86.01 |
| 6,116,438 | A | 9/2000 | Lovett | |
| 6,257,406 | B1 | 7/2001 | Garino | |
| 6,402,000 | B1 | 6/2002 | Stark | |
| 6,913,385 | B1 | 7/2005 | Sagos | |
| 7,021,460 | B2 | 4/2006 | Roeback et al. | |
| 7,562,408 | B1 * | 7/2009 | Johnson | B60P 3/38 224/572 |
| 2003/0164347 | A1 | 9/2003 | Bouvier, Jr. | |
| 2005/0229329 | A1 | 10/2005 | Miller | |
| 2008/0276481 | A1 | 11/2008 | Mizereck | |
| 2010/0002960 | A1 | 1/2010 | Lasko | |

(Continued)

*Primary Examiner* — Jes F Pascua

(74) *Attorney, Agent, or Firm* — Pierson IP, PLLC

(57) ABSTRACT

Embodiments disclosed herein describe systems and methods for a stabilized and dynamic storage system. Embodiments may be configured to be secured to a support structure, such as a fence, wall, etc. at a plurality of locations, while allowing objects to be stored within the storage system. By coupling the storage system to the support structure at a plurality of locations, stress applied by the objects positioned within the storage system may be distributed across the storage system.

20 Claims, 15 Drawing Sheets

(56) References Cited

U.S. PATENT DOCUMENTS

| | | | | |
|---|---|---|---|---|
| 2010/0003887 | A1* | 1/2010 | Greene ..... | B65D 29/04<br>446/75 |
| 2010/0108627 | A1 | 5/2010 | Lupinacci et al. | |
| 2012/0292313 | A1 | 11/2012 | Erlich et al. | |

* cited by examiner

SYSTEMS AND METHODS ASSOCIATED WITH A STABILIZED STORAGE CONTAINER

CROSS-REFERENCE TO RELATED APPLICATIONS

This application claims a benefit of priority under 35 U.S.C. § 119 to Provisional Application Nos. 63/395,342 filed on Sep. 15, 2016 and 62/375,144 filed on Aug. 15, 2016, which are fully incorporated herein by reference in their entirety.

BACKGROUND INFORMATION

Field of the Disclosure

Examples of the present disclosure are related systems and methods associated with a stabilized storage container. More specifically, embodiments are directed towards a storage container with a plurality of external and internal coupling members positioned on the upper and lower edges of the storage containers.

Background

There has always been a need for household and commercial storage solutions for various sized objects. For example, a household with children may have sports equipment in numerous shapes and sizes, which all need to be stored when not in use. Similarly, households having pools or outdoor furniture with inflatable rafts or cushions need proper storage solutions.

Conventionally to store objects, rigid and solid storage containers have been used. However, these rigid and solid storage containers are static in shape and are not able to adapt to various sized objects. Furthermore, these rigid and solid storage containers typically do not allow for proper airflow through the containers, which may cause wet objects stored inside the storage containers to dry more slowly or not at all.

Alternatively, to store objects, netted bags that include an opening at the top of the bag have been used. These netted bags can expand and contract to accommodate the shape of objects positioned within the bag. However, if heavier or larger objects are positioned within the bag, the objects within the bag may move towards a concentrated area. This may squish or deform the objects with the bags. Additionally, responsive to positioning objects within the netted bags, the shape of the netted bag may deform such that the objects positioned within the netted bag are no longer accessible. Furthermore, if the objects within the netted bag are concentrated, then the objects positioned within the netted bags may dry slower if wet.

Accordingly, needs exist for more effective and efficient systems and methods for a stabilized storage container with multiple coupling mechanisms that are positioned on upper and lower surfaces of the storage container, as well as internally and externally positioned on the storage container.

SUMMARY

Embodiments disclosed herein describe systems and methods for a stabilized and dynamic storage system. Embodiments may be configured to be secured to a support structure, such as a fence, post, pool, wall, etc. at a plurality of locations, while allowing objects to be stored and accessed within the storage system. By coupling the storage system to the support structure at a plurality of locations, stress applied by the objects positioned within the storage system may be distributed across the storage system. This may allow the storage system to be stabilized and semi-retain its shape, while allowing larger objects to be positioned within the storage system.

The storage system may include a netted container and coupling members.

The netted container may be comprised of fabric forming a mesh or webbed net. The netted container may be configured to secure objects within a body of the storage system, while also allowing a user to access and view the objects secured within the body. The netted container may be configured to expand responsive to larger objects being positioned within the body, and retract to its original shape responsive to removing the objects from within the body. The netted container may include an open top end, a closed bottom end, a front surface, and a planar rear surface.

Coupling members may be positioned along an edge of the open top end, along the edges of the planar rear surface, and along an edge of the closed bottom end. In embodiments, there may be four external coupling members along the edge of the open top end, four internal coupling members along the edge of the open top end, two coupling members on each side of the planar rear surface, and two internal coupling members along the closed bottom end.

In implementations, the external coupling members may be configured to removably couple the storage system to the support structure. The internal coupling members may be configured to be coupled together to distribute the weight of objects stored within the storage system to other locations along the storage system, and to help the storage system to retain its shape.

Furthermore, because the number of internal coupling members positioned along the open top end and the closed bottom end differ, the storage system may have different configurations based on the characteristics of the objects stored within the storage system. These different configurations may be utilized to more efficiently and effectively store objects with different characteristics, such as weight, size, shape, etc. However, in other embodiments the number of internal coupling members positioned long the open top end and the closed bottom end may be the same.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
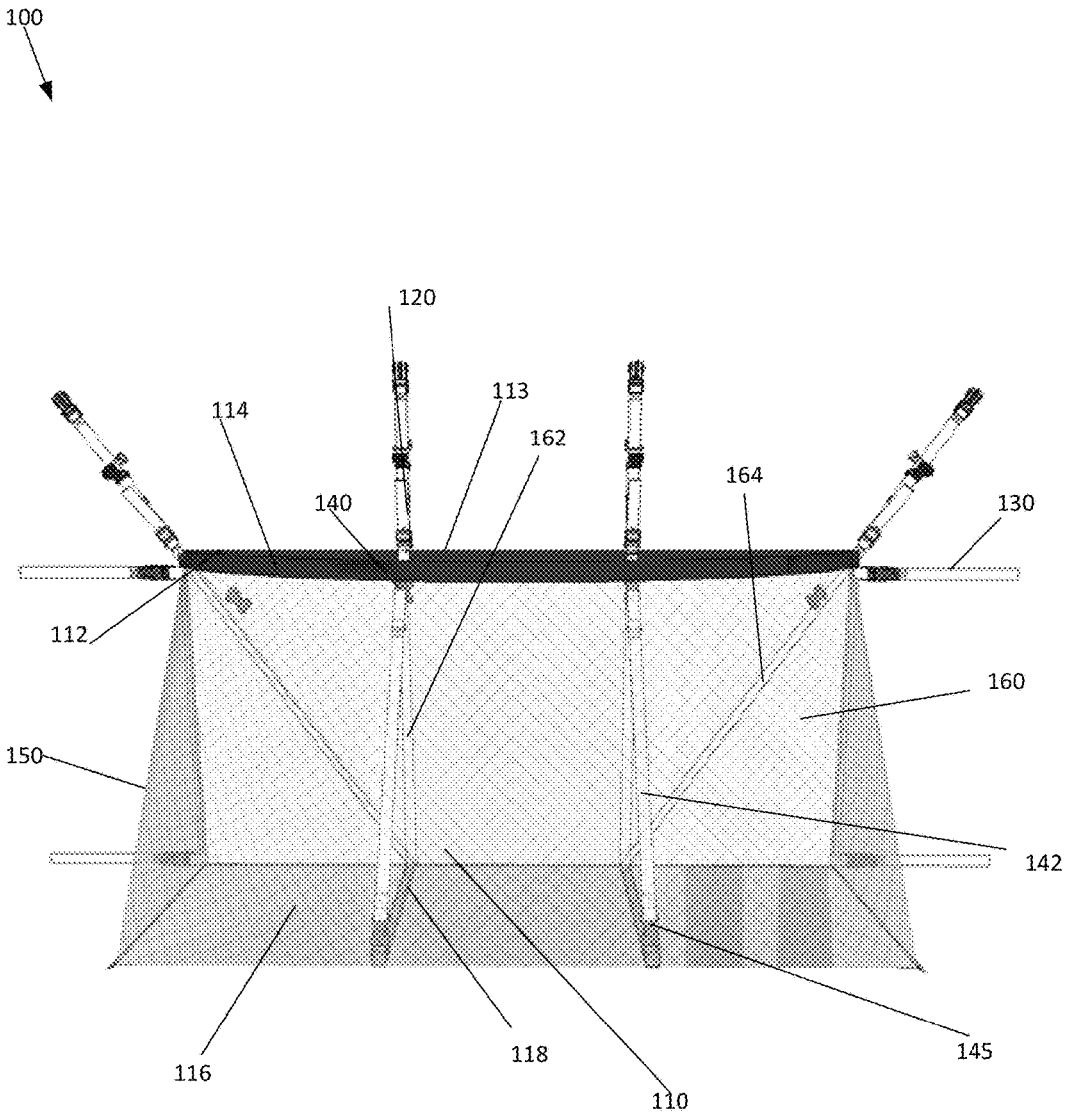
FIG. 1 depicts a storage system, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments disclosed herein describe systems and methods for a stabilized and dynamic storage system. Embodiments may be configured to be secured to a support structure, such as a fence, wall, etc. at a plurality of locations, while allowing objects to be stored within the storage system. By coupling the storage system to the support structure at a plurality of locations, stress applied by the objects positioned within the storage system may be distributed across the storage system.

FIG. 1 depicts storage system 100, according to an embodiment. Storage system 100 may include netted container 110, upper external coupling members 120, side external coupling members 130, coupling strap 142, upper internal coupling members 140, and lower internal coupling members 145.

Netted container 110 may be comprised of fabric forming a mesh or webbed bag. The netted container may be configured to secure objects within a body of storage system 100, while also allowing a user to view and touch the objects secured within the body. Netted container 110 may be configured to expand responsive to larger objects being positioned within the body, and retract to its original shape responsive to removing the objects from within the body. Netted container 110 may include open top end 112, closed bottom end 116, front surface 150, and rear surface 160.

Open top end 112 may be configured to provide access to the cavity or body formed within netted container 110. Open top end may be comprised of rear edge 113 and an elastic band 114.

Rear edge 113 may extend from a first side of netted container 110 to a second side of netted container 110. In embodiments, rear edge 113 may be configured to be positioned adjacent to a support structure.

Elastic band 114 may extend from the first side of rear edge 113 to the second side of rear edge 113. Elastic band 114 may be configured to be positioned away from rear edge 113 to allow access to the cavity or body within netted container 110. Elastic band 114 may be configured to expand and retract to dynamically change the shape and/or size of the opening between elastic band 114 and rear edge 113. Responsive to applying force to elastic band 114, elastic band 114 may expand. This may cause the opening to increase in size. Responsive to no longer applying force to elastic band 114, elastic band 114 may contract. This may cause the opening to decrease in size. When the opening increases in size, larger objects may be placed or removed within the cavity.

Closed bottom end 116 may be positioned on an opposite side of netted container 110 than open top end 112. Closed bottom end 116 may be a sealed surface without an opening, which may be configured to contain objects within the cavity of netted container 110. In embodiments, closed bottom end 116 may have a surface area that is larger than open top end 112 while elastic band 114 is expanded and/or retracted. However, in other embodiments, closed bottom end 116 may have a surface area that is smaller surface area than open top end 112 while elastic band 114 is expanded.

In embodiments, closed bottom end 116 may include stabilization straps 118. Stabilization straps 118 may be comprised of a different material than netted container 110. For example, stabilization straps 118 may be formed of more rigid or sturdy materials than netted container 110. However, stabilization straps 118 may still be comprised of flexible, pliable, etc. materials. Stabilization straps 118 may be configured to extend in a direction perpendicular to a width of closed bottom end 116, which may extend from the front end to the back end of closed bottom end 116. Stabilization straps 118 may be configured to stabilize netted container 110 by distributing weight applied to closed bottom end 116 to other areas of netted container 110, while also assisting netted container 110 to retain its shape.

Front surface 150 may have a proximal end positioned adjacent to elastic band 114, and may have a distal end positioned adjacent to a front end of closed bottom end 116. The front surface 150 may be angled to decrease the surface area from closed bottom end 116 to elastic band 114 based on the elasticity of elastic band 114. In embodiments, the angling and positioning of front surface 150 may be based on the shape and/or sizing of the objects within the netted container's 110 cavity.

Rear surface 160 may include a proximal end positioned adjacent to rear edge 113, and a distal end positioned adjacent to a back surface of closed bottom end 116. Rear surface 160 may be configured to be positioned adjacent to a support structure, such as posts, a wall, etc. In embodiments, rear surface 160 may have a greater surface area than closed bottom end 116. Based on the dimensions of closed bottom end 116 and rear surface 160, forces created by objects positioned within netted container's 110 cavity may be more evenly and efficiently distributed within system 100.

In embodiments, rear surface 160 may include stabilization straps 162 and 164. Stabilization straps 162, 164 may be comprised of a different material than netted container 110. For example, stabilization straps 162, 164 may be formed of more rigid or sturdy materials than netted container 110. However, stabilization straps 162, 164 may still be comprised of flexible, pliable, etc. materials. Stabilization straps 162 may be configured to extend in a direction perpendicular to a width of rear surface 160, which may extend from the top end to the bottom end of rear surface 160. Stabilization straps 164 may extend from a location proximate to or at an intersection of stabilization straps 162 and 118 to upper corners of rear surface 160. Therefore, stabilization straps 164 may have first ends that are internally positioned within netted container 110, and have second ends that are positioned along the boundary of netted container 110. Stabilization straps 162, 164 may be configured to stabilize netted container 110 by distributing weight applied to system 100 to other areas of netted container 110, while also assisting netted container 110 with retaining its shape.

Upper external coupling members 120 may be configured to couple system 100 with a support structure, such as posts, garage, fence, wall, etc. Upper external coupling members 120 may be positioned externally from the cavity formed by netted container 110, and may have first ends that are permanently coupled to netted container 110. A first of coupling members 120 may be positioned at an upper right corner of system 100, a second of coupling members 120 may be positioned at an upper left corner of system 100, which may be aligned with support straps 162. The two other coupling members 120 may be positioned in between the sides of system 100, wherein these two coupling members 120 may be aligned with support straps 162. Coupling members 120 include male and female coupling portions that are configured to interface with each other. When the male and female coupling portions are disengaged from one another, they may be wrapped around a support structure. Then, the male and female coupling portions may be interfaced with each other to form a loop. The size of the loop may be adjustable, such that the loop may be tightened around the support structure. Furthermore, the length of coupling members 120 may be adjustable, such that each coupling member 120 may have its length independently increased or decreased. In embodiments, the innermost coupling members positioned between the right and left corners of system 100 may include different attachment mechanisms than the outermost coupling members 120. For example, the innermost coupling members 120 may include hanging hooks, pegs, etc. configured to couple to a ledge or depression on the support structure, while the outermost coupling members 120 may include the male and female coupling portions configured to wrap around the support structure.

Side external coupling members 130 may be tie straps configured to assist in coupling system 100 with the support structure. In embodiments, side external coupling members 130 may be detachable straps with no male or female coupling portions on their ends, which may allow external coupling members 130 to be tied around support structures. Side external coupling members 130 may include inner male and female coupling portions, which allow coupling members 130 to be removed from system 100. Side external coupling members 130 may be positioned proximate to each of the corners of rear surface 160. Side external coupling members 130 may be different than upper external coupling members 120. Thus, side external coupling members 130 implement different coupling techniques and components from that of upper external coupling members 120.

Coupling straps 142 may be configured to be positioned within the cavity in netted container 110. Coupling straps 142 may have ends with male or female coupling portions, with a piece of fabric between the ends, wherein the length of the fabric may be dynamically changed. Coupling straps 142 are configured to couple internal coupling members 140, 145. Responsive to joining coupling straps 142 with coupling members 140, 145, coupling straps 142 may assist in redistributing forces applied to netted container 110 by stored objects, while also assisting in maintaining the shape of netted container 110. Furthermore, by internally positioning coupling straps 142 within the cavity in netted container 110, coupling straps 142 may not form a hazard for users around system 100.

Upper internal coupling members 140 may be positioned along rear edge 113, and may be aligned with upper external coupling members 120. Upper internal coupling members 140 may have a first end that is directly affixed to rear edge 113, and a second end that has a male or female coupling portion. Upper internal coupling members 140 may be configured to be coupled with proximal ends of coupling straps 142. In embodiments, there may be fewer number of coupling straps 142 than upper internal coupling members 140. Therefore, each of the upper internal coupling members 140 may not be simultaneously used.

Lower internal coupling members 145 may be positioned along the front edge of closed bottom end 116, and may be aligned with lower stabilization strap 118. Lower internal coupling members 145 may have a first end that is directly affixed to closed bottom end 116, and a second end that has a male or female coupling portion. Lower internal coupling members 145 may be configured to be coupled with the distal ends of coupling straps 142. In embodiments, there may be an equal number of coupling straps 142 and lower internal coupling members 145. Therefore, each of the upper internal coupling members 140 may be simultaneously used.

Figure 2:
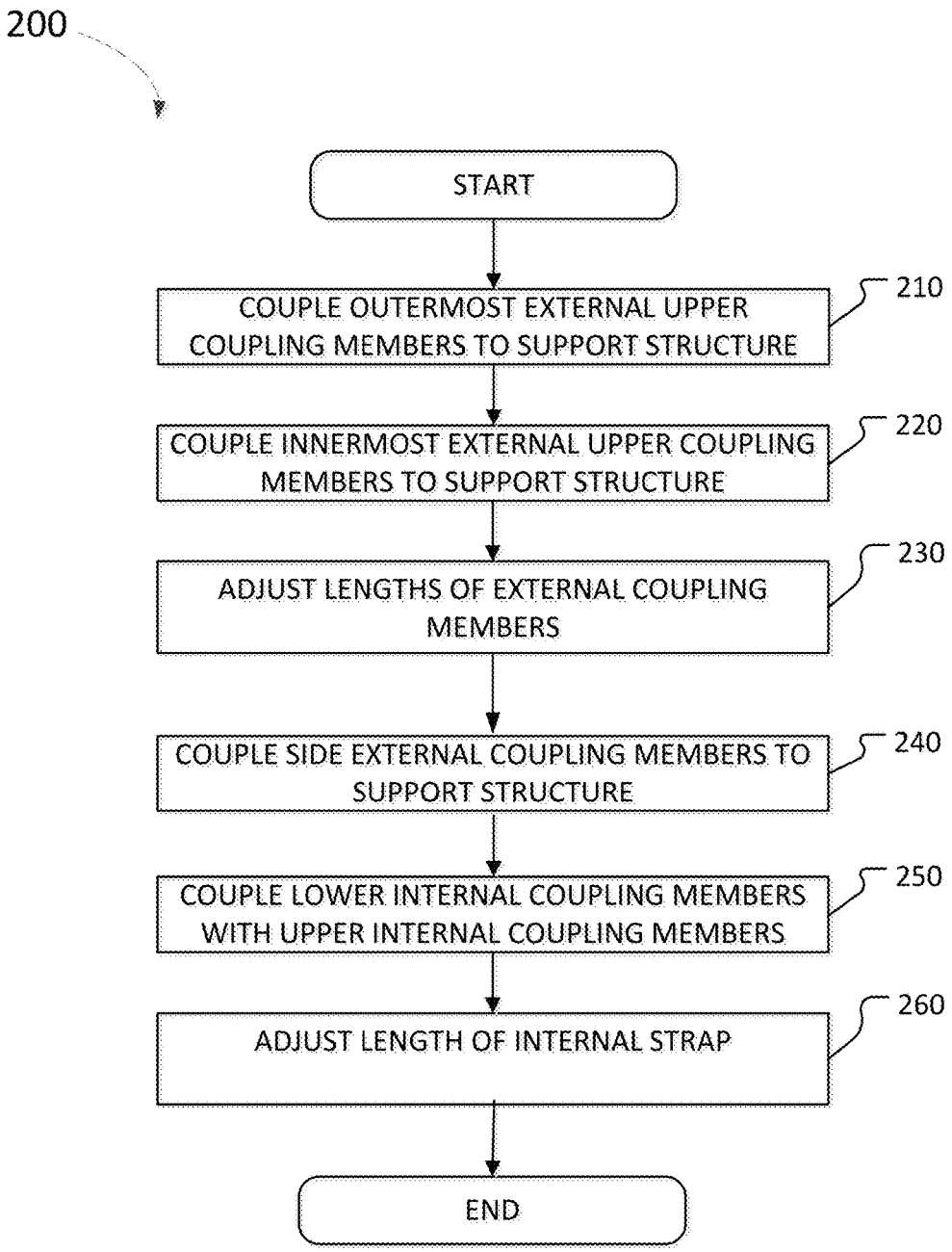
FIG. 2 depicts a method for utilizing a stabilized storage container, according to an embodiment.

FIG. 2 depicts a method 200 for utilizing a stabilized storage container 100, according to an embodiment. The operations of method 200 presented below are intended to be illustrative. In some embodiments, method 200 may be accomplished with one or more additional operations not described, and/or without one or more of the operations discussed. Additionally, the order in which the operations of method 200 are illustrated in FIG. 2 and described below is not intended to be limiting.

At operation 210, the outermost external, upper coupling members may be affixed to a support structure. The outermost external and upper coupling members may be affixed by looping corresponding non-linked coupling portions around the support structure, and then linking, joining, buckling, etc. the coupling portions together. The size of the loop may then be adjusted based on the size of the support structure.

At operation 220, the innermost, external, upper coupling members may be coupled to the support structure. These coupling members may be coupled in the same manner as in operation 210, or by utilizing hooks positioned on the innermost, external, upper coupling members. These hooks may be utilized to latch around the support structure.

At operation 230, a length of all or some of the upper coupling members may be adjusted.

At operation 240, the side external coupling members may be tied around the support structure. This may reduce swaying of the storage container. Furthermore, the side external coupling members may be configured to stretch the upper portion of the bag laterally to stretch the rear surface so it stays relatively flat against the support structure when users pull open the front upper surface of the storage container.

At operation 250, the lower internal coupling members may be coupled to select upper internal coupling members via the coupling straps.

At operation 260, the length of the coupling straps may be adjusted to assist in stabilizing the storage container, while allowing the storage container to be flexible.

Figure 3:
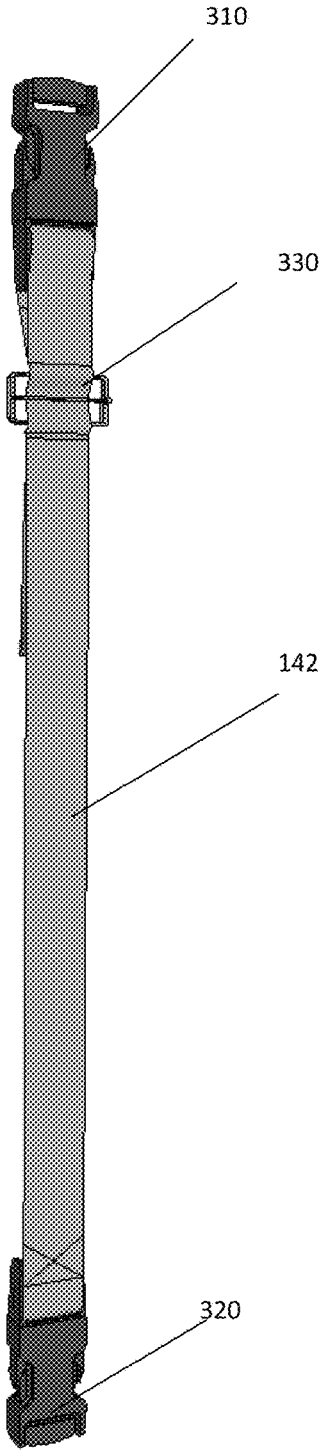
FIG. 3 depicts a coupling strap, according to an embodiment.

FIG. 3 depicts coupling strap 142, according to an embodiment. Elements depicted in FIG. 3 may be described above. For the sake of brevity, another description of these elements is omitted.

As depicted in FIG. 3, a proximal end of coupling strap 142 may include a first coupling portion 310, and a distal end of coupling strap 142 may include a second coupling portion 320. First coupling portion 310 may be configured to be coupled with an upper internal coupling member, and second coupling portion 320 may be configured to be coupled with a lower internal coupling member.

A length of coupling strap 142 may be adjusted via buckle 330, wherein the length of coupling strap 142 may be increased or decreased by sliding buckle 330 along coupling strap 142.

Figure 4:
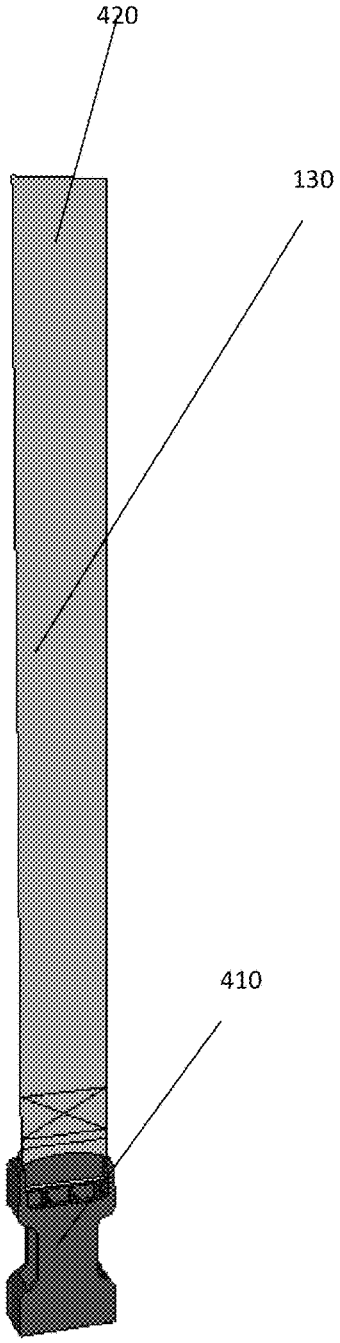
FIG. 4 depicts a side external coupling member, according to an embodiment.

FIG. 4 depicts side external coupling member 130, according to an embodiment. Elements depicted in FIG. 4 may be described above. For the sake of brevity, another description of these elements is omitted.

As depicted in FIG. 4, a first end 410 of an external coupling member 130 may include a male or female coupling portion, which may be utilized to removably link coupling member 140 to netted container 110. However, a second end 420 of side external coupling member 130 may not include a male or female coupling portion. This may allow second end 420 of side external coupling member 130 to be more easily and efficiently tied around a support structure.

Figure 5:
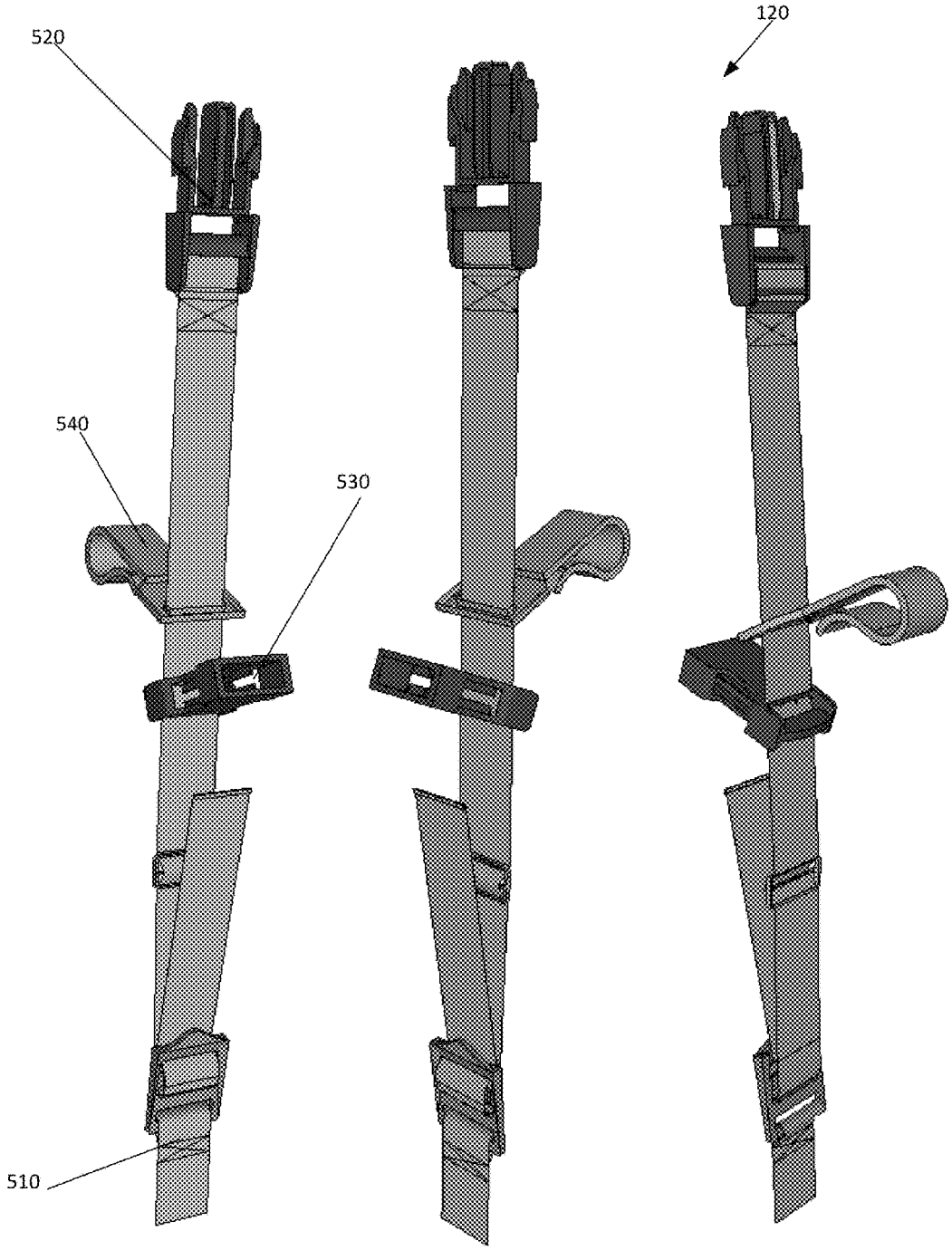
FIG. 5 depicts various views of an upper external coupling member, according to an embodiment.

FIG. 5 depicts various views of upper external coupling member 120, according to an embodiment. Elements depicted in FIG. 5 may be described above. For the sake of brevity, another description of these elements is omitted.

AS depicted in FIG. 5, a proximal end 510 of coupling member 120 may include a strap that is affixed to netted container 110. A second end of coupling member may include a first coupling portion 520, which is configured to be selectively coupled to second coupling portion 530. First and second coupling portions 520, 530 may be removably coupled together to loop coupling member 120 around an object. Hook 540 may be positioned between first coupling portion 520 and second coupling portion 530, and may be configured to be press fitted around a support structure.

Figure 6:
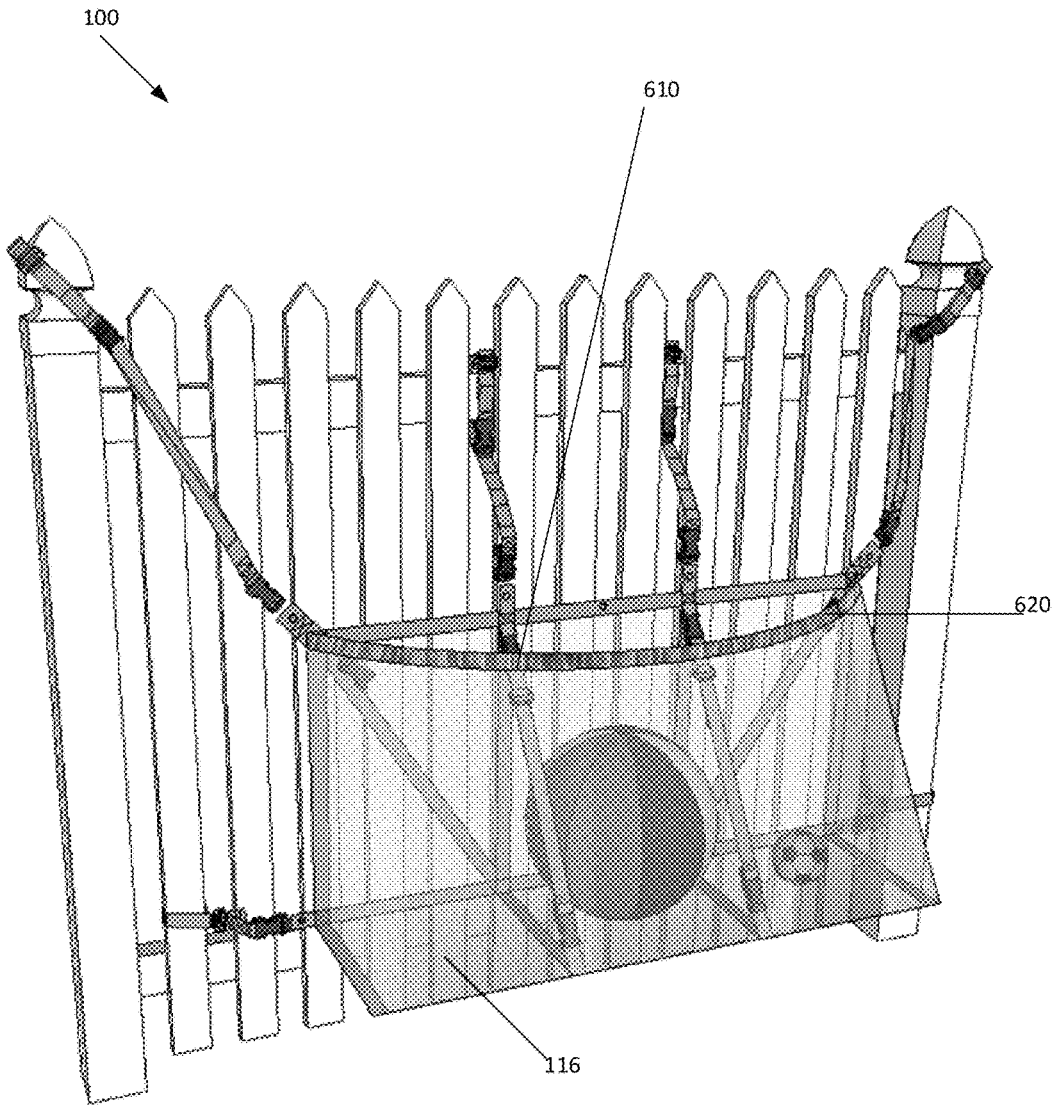
FIGS. 6 and 7 depict a storage system, according to embodiments.
Figure 7:
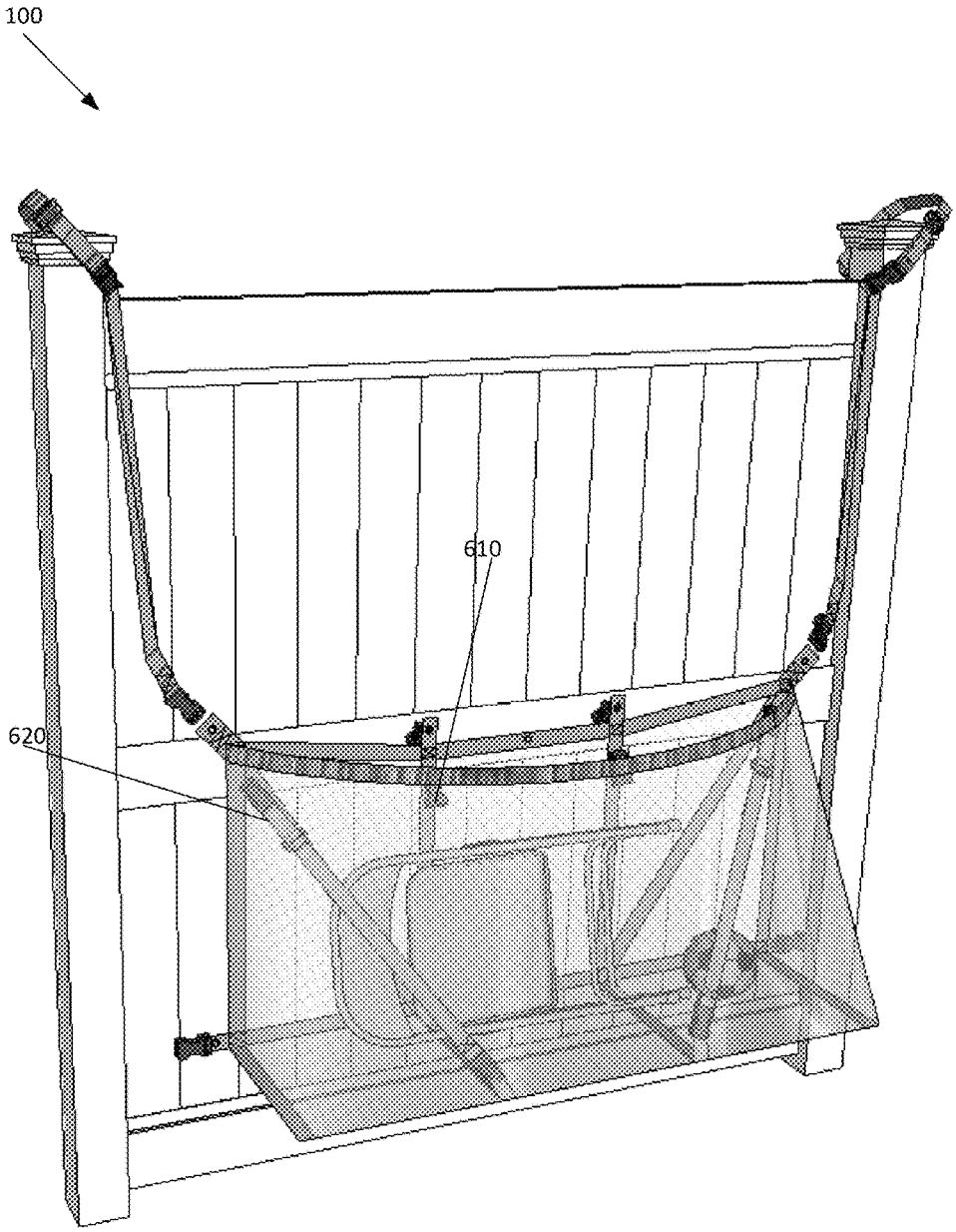
Figure 8:
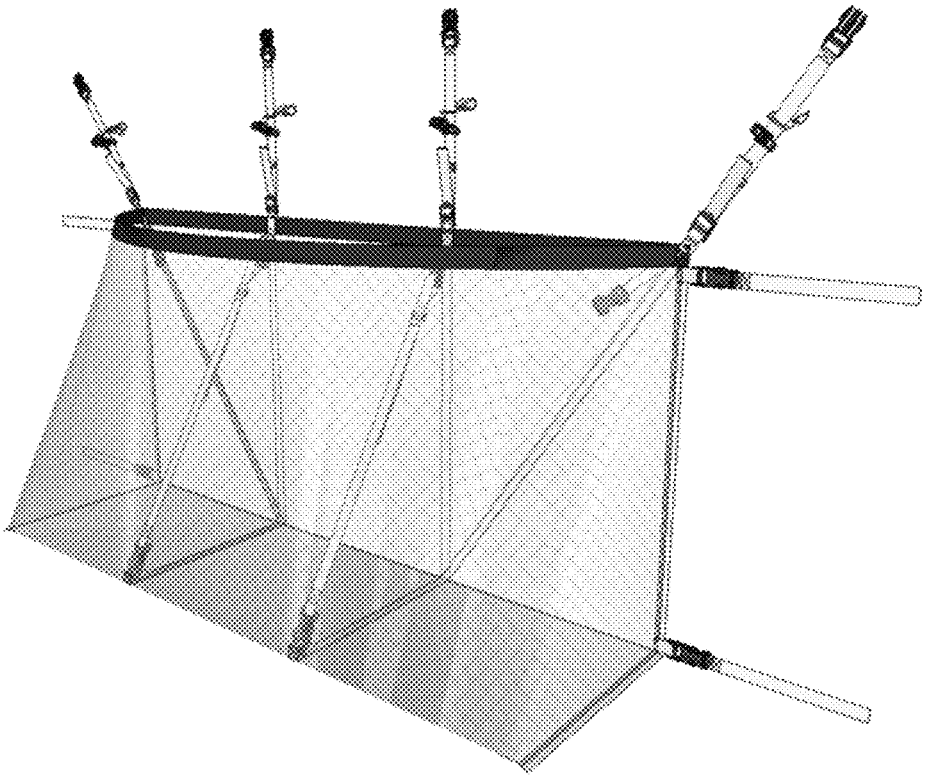
FIGS. 8-21 depict various views of a storage system, according to embodiments.
Figure 9:
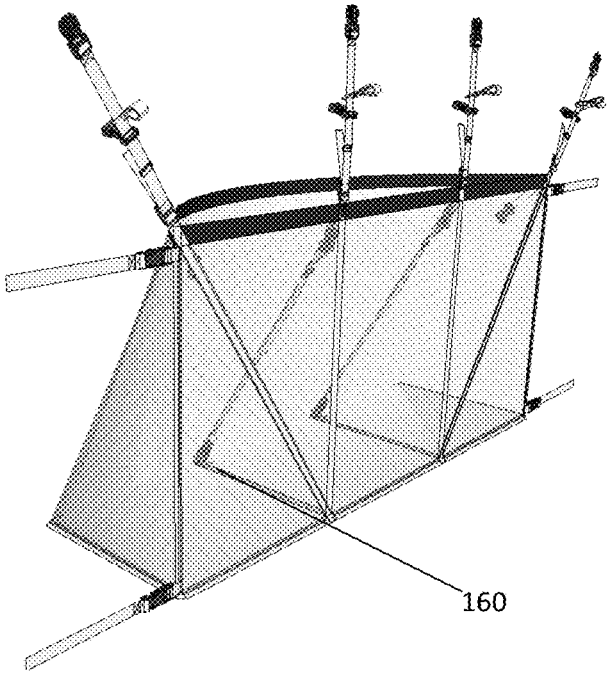
Figure 10:
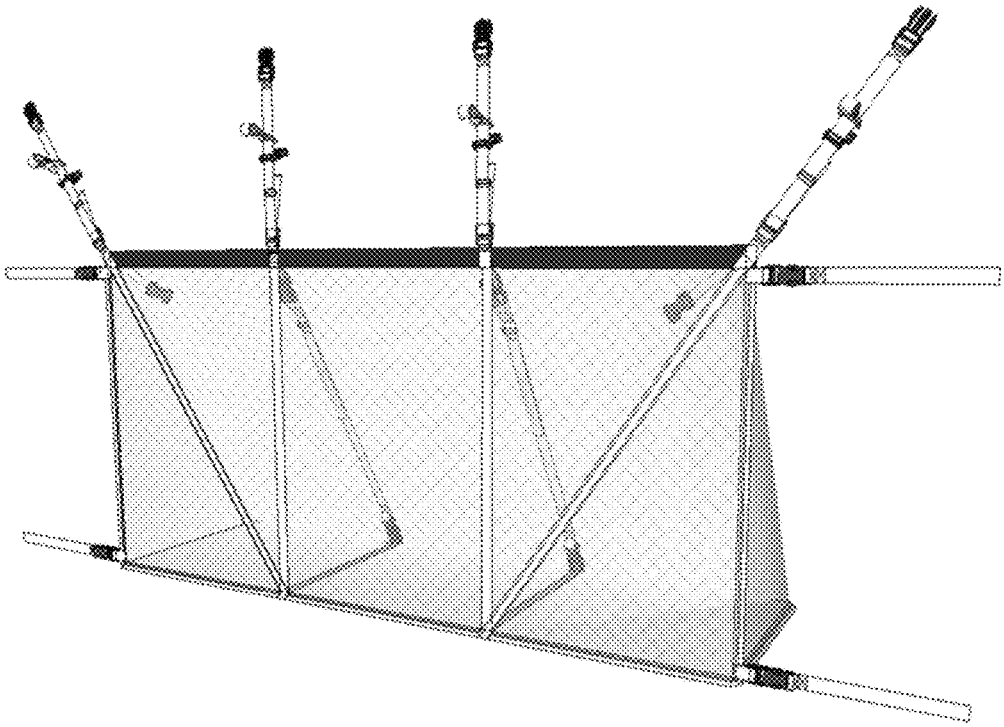
Figure 11:
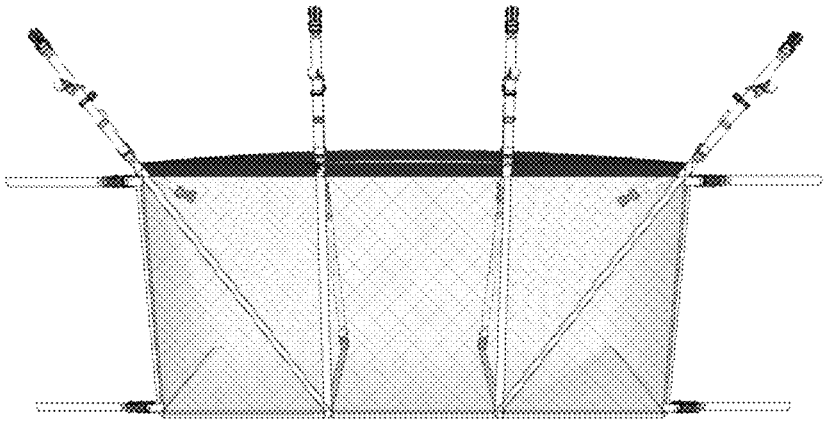
Figure 12:
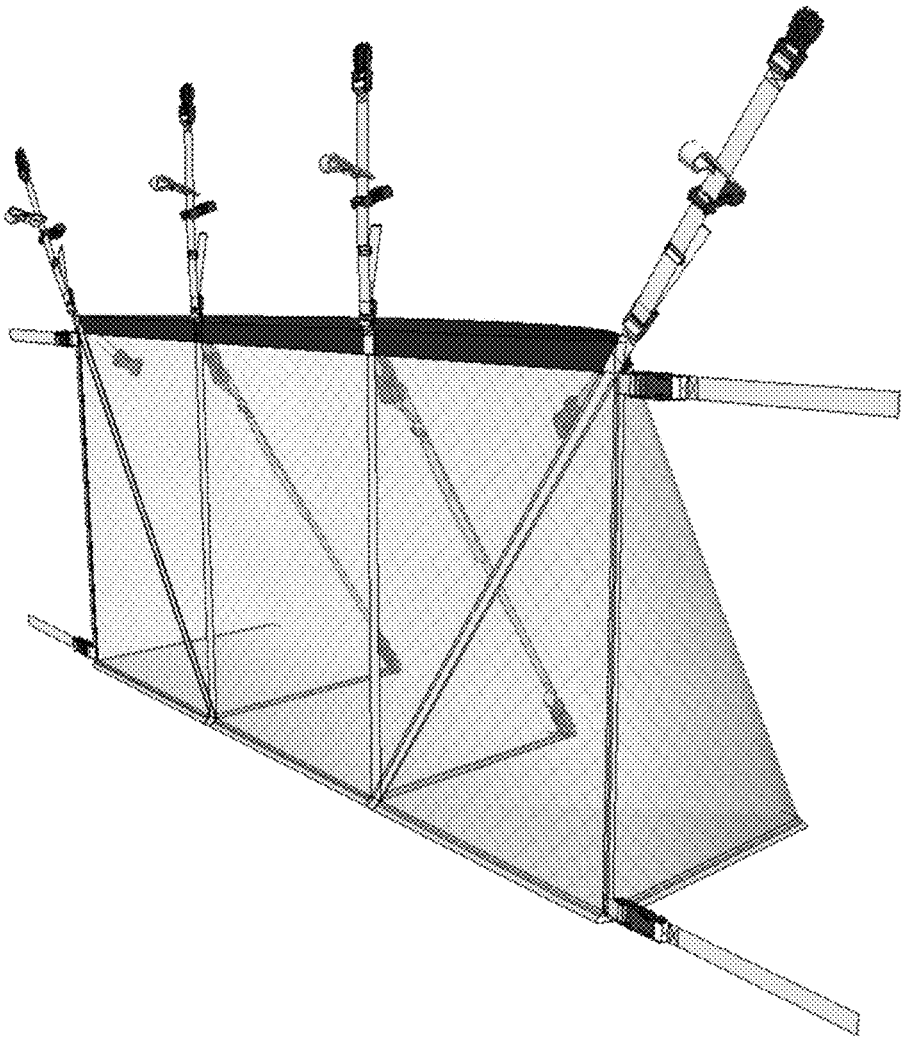
Figure 13:
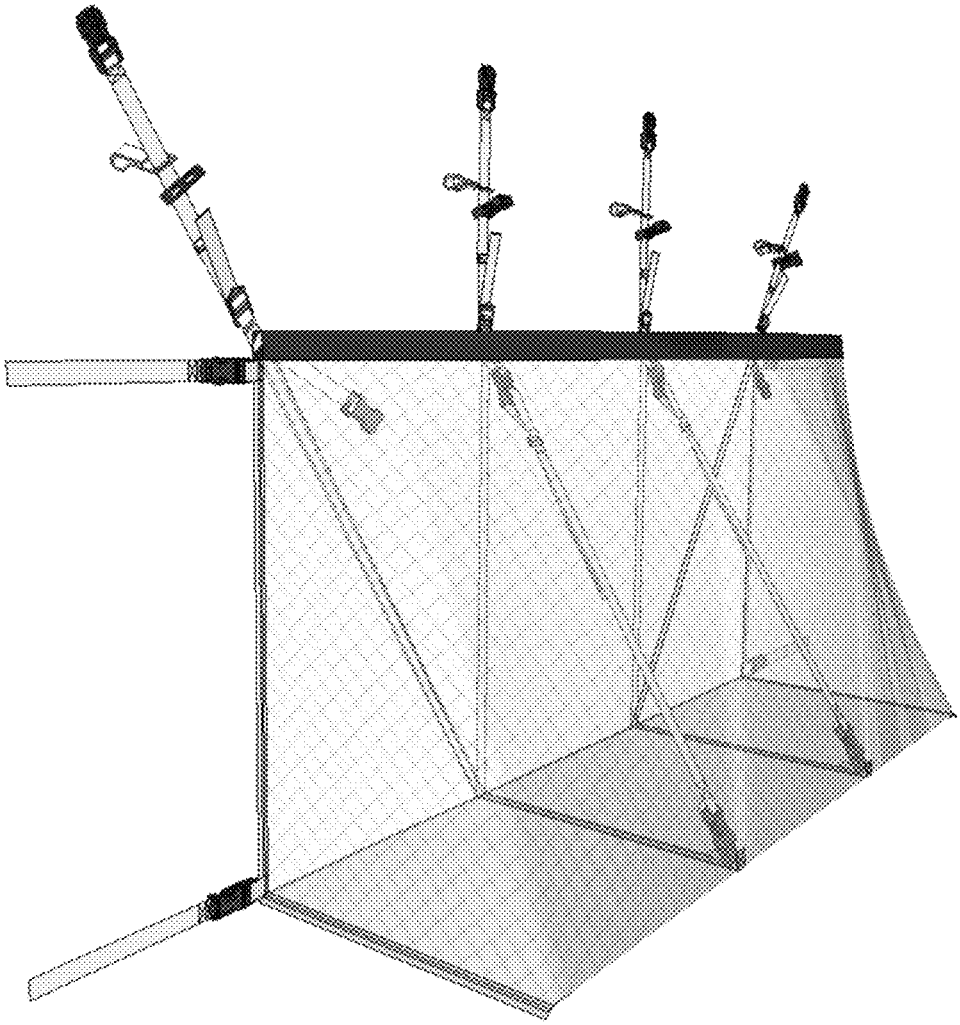
Figure 14:
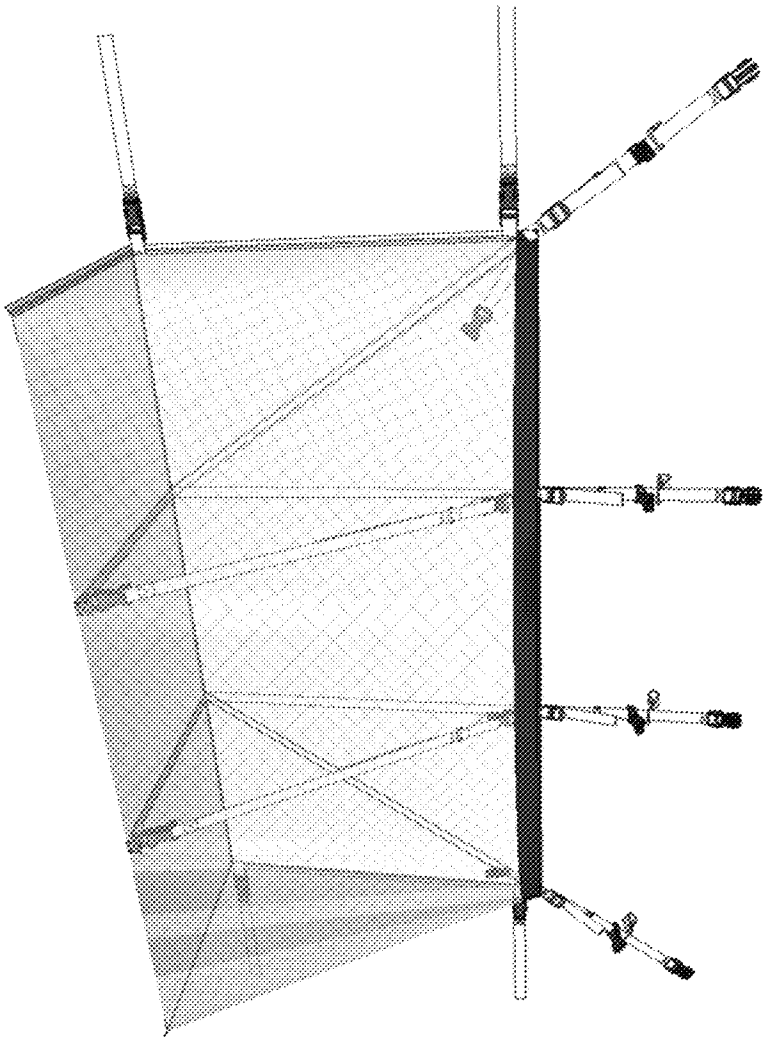
Figure 15:
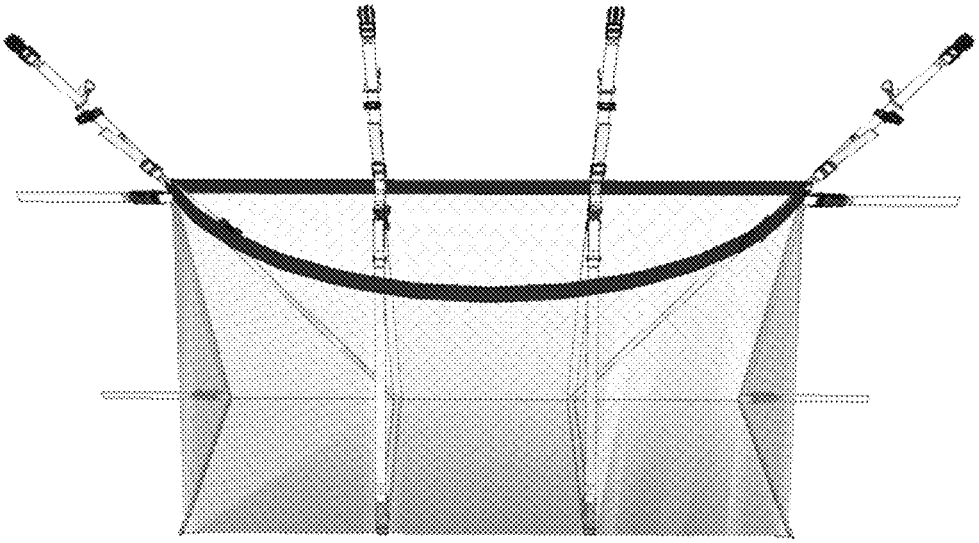
Figure 16:
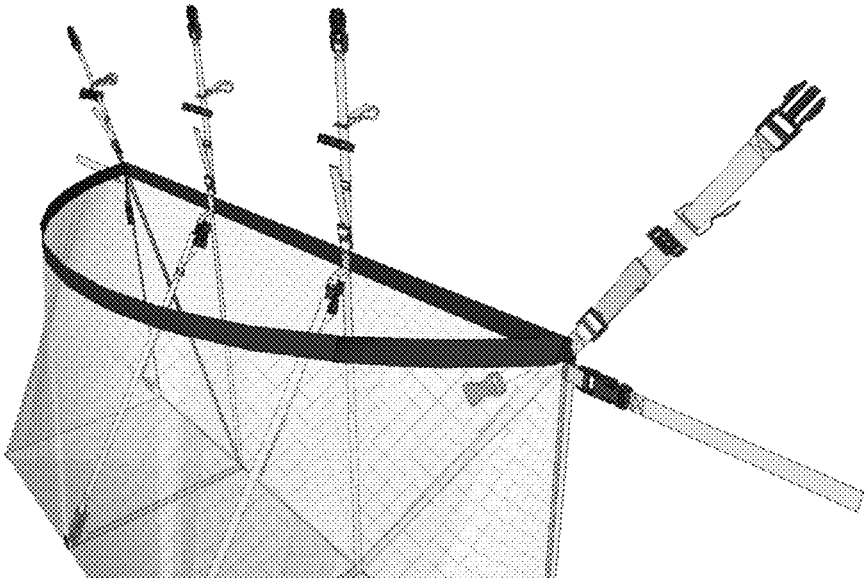
Figure 17:
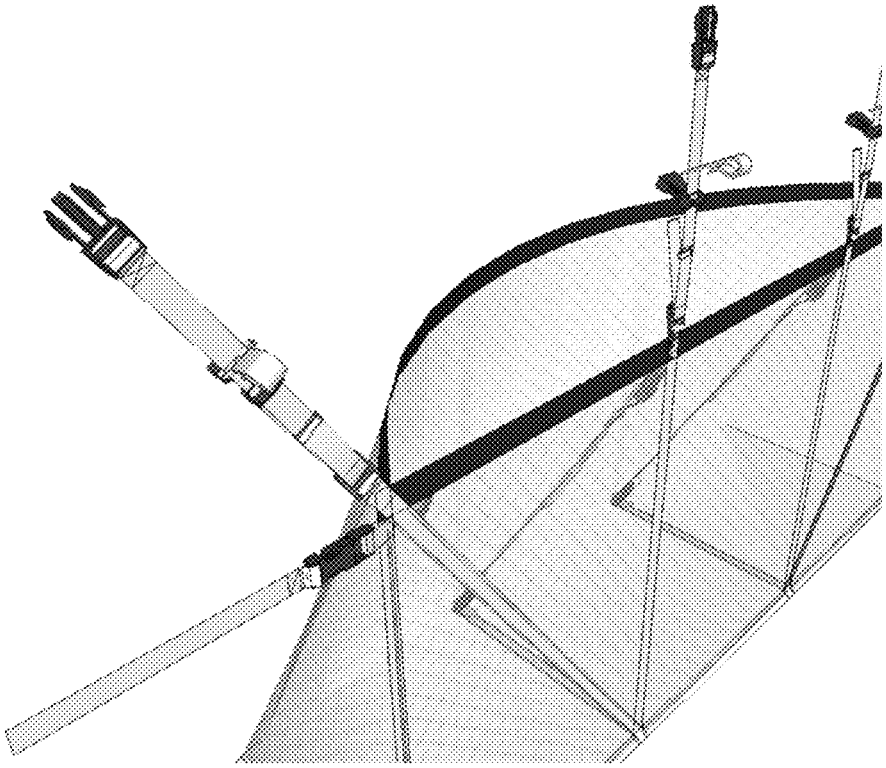
Figure 18:
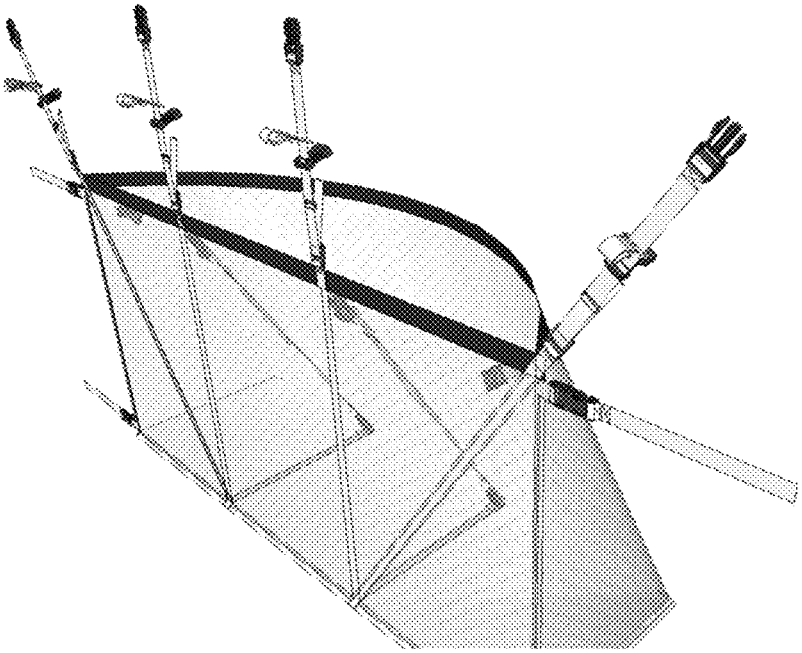
Figure 19:
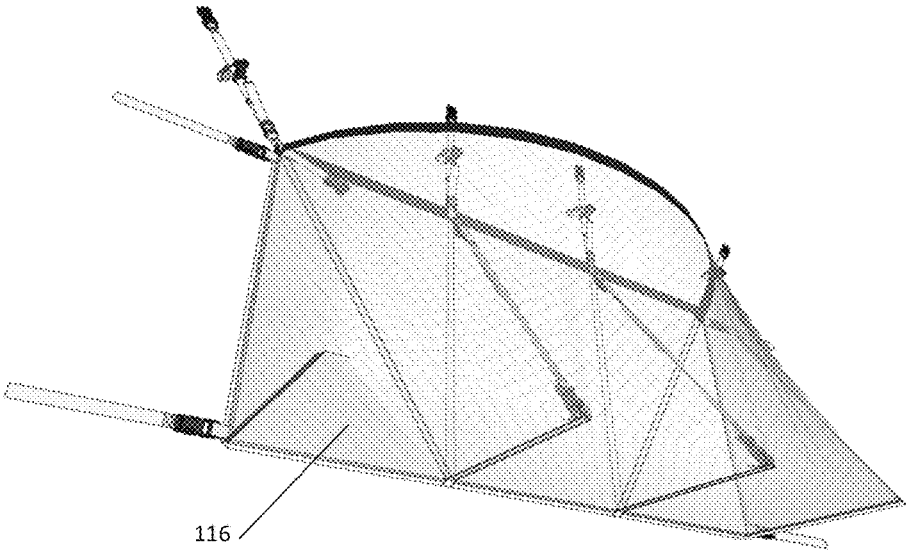
Figure 20:
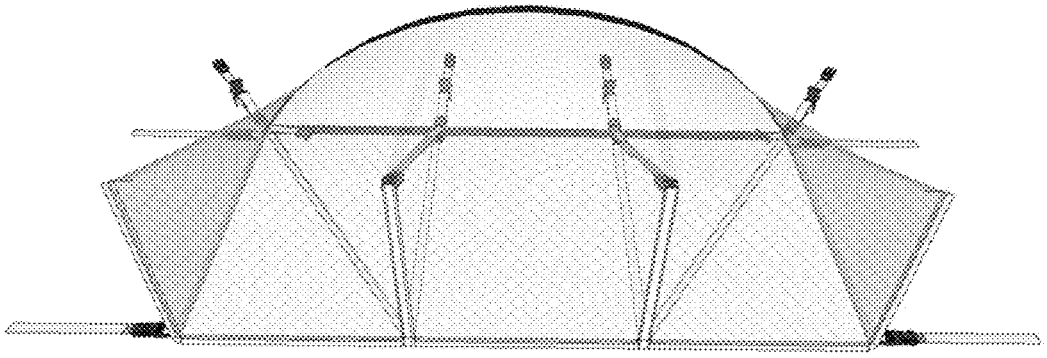
Figure 21:
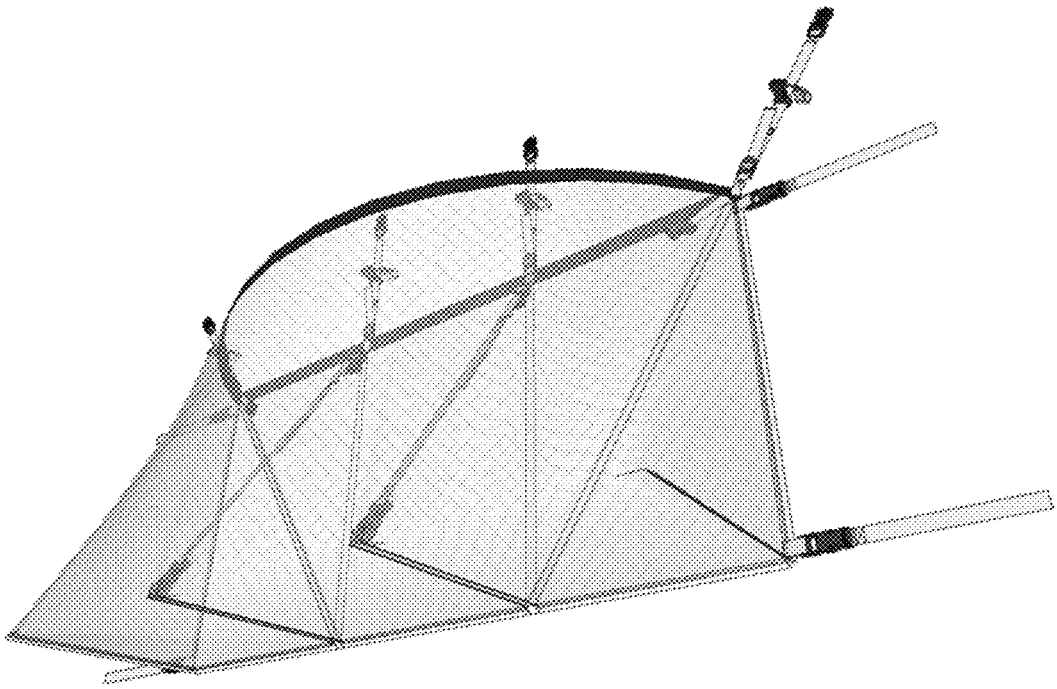

FIGS. 6 and 7 depict system 100, according to embodiments. Elements depicted in FIGS. 6 and 7 may be described above. For the sake of brevity, another description of these elements is omitted.

As depicted in FIG. 6, straps 142 may be coupled to the innermost upper internal coupling members 610 and to the lower internal coupling members 145. However, the outermost internal coupling members 620 may not be coupled to any straps 142.

As shown in FIG. 7, straps 142 may be coupled to the outermost upper internal coupling members 120 and to the lower internal coupling members 145. However, the innermost internal coupling members 610 may not be coupled to any straps 142. The positioning of straps 142 may be based on a plurality of factors including, but not limited to, the shape and/or size of the support structure, the shape, weight, size and/or weight of the objects positioned within netted container 110, etc.

FIGS. 8-21 depicts various views of system 100, according to embodiments.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A storage system comprising:

a netted container with an open top surface and a closed bottom surface, wherein the open top surface includes an elastic band that is configured to expand and retract;

first coupling members positioned outside the upper top surface;

second coupling members positioned on sides of the netted container;

third coupling members positioned within a cavity within the netted container proximate to the upper top surface of the netted container;

fourth coupling members positioned within the cavity within the netted container proximate to a front edge of the closed bottom surface;

straps configured to couple the third coupling members with the fourth coupling members, wherein the straps are configured to be entirely positioned within the cavity.

2. The system of claim 1, wherein the third coupling members include four coupling members, and the fourth coupling members include two coupling members.

3. The system of claim 1, wherein the closed bottom surface includes first stabilization straps extending from a front end of the closed bottom surface to a rear end of the closed bottom surface, the first stabilization straps being comprised of a different material than the netted container.

4. The system of claim 3, further comprising:

a rear surface positioned between the open top surface and the closed bottom surface, the rear surface including second stabilization straps and third stabilization straps.

5. The system of claim 4, wherein the second stabilization straps extend in parallel to a height of the netted container, and the third stabilization straps include a proximal end positioned adjacent to an end of the first straps and a distal end positioned at corners of the rear surface.

6. The system of claim 5, wherein the fourth coupling members are aligned with the first stabilization straps.

7. The system of claim 5, wherein the first coupling members and the third coupling members are aligned with each other.

8. The system of claim 1, wherein a length of the straps is adjustable.

9. The system of claim 1, wherein the second coupling members include different coupling mechanisms than the first coupling members.

10. The system of claim 1, wherein a length of the second coupling members is not adjustable.

11. A method utilizing a storage system comprising:

linking first coupling members to an outer and upper top surface of a netted container, the netted container including an open top surface and a closed bottom surface, wherein the open top surface includes an elastic band that is configured to expand and retract;

linking second coupling members to sides of the netted container;

positioning third coupling members within a cavity within the netted container proximate to the upper top surface of the netted container;

positioning fourth coupling members within the cavity within the netted container proximate to a front edge of the closed bottom surface;

coupling the third coupling members with the fourth coupling members via straps, wherein the straps are entirely positioned within the cavity.

12. The method of claim 11, wherein the third coupling members include four coupling members, and the fourth coupling members include two coupling members.

13. The method of claim 11, wherein the closed bottom surface includes first stabilization straps extending from a front end of the closed bottom surface to a rear end of the closed bottom surface, the first stabilization straps being comprised of a different material than the netted container.

14. The method of claim 13, further comprising:

a rear surface positioned between the open top surface and the closed bottom surface, the rear surface including second stabilization straps and third stabilization straps.

15. The method of claim 14, wherein the second stabilization straps extend in parallel to a height of the netted container, and the third stabilization straps include a proximal end positioned adjacent to an end of the first straps and a distal end positioned at corners of the rear surface.

16. The method of claim 15, wherein the fourth coupling members are aligned with the first stabilization straps.

17. The method of claim 15, wherein the first coupling members and the third coupling members are aligned with each other.

18. The method of claim 11, further comprising:

adjusting a length of the straps.

19. The method of claim 11, wherein the second coupling members include different coupling mechanisms than the first coupling members.

20. The method of claim 11, wherein a length of the second coupling members is not adjustable.

* * * * *